US006929071B2

(12) United States Patent
Moncus et al.

(10) Patent No.: US 6,929,071 B2
(45) Date of Patent: Aug. 16, 2005

(54) MOTION COMPENSATION SYSTEM AND METHOD

(75) Inventors: James Devin Moncus, Lafayette, LA (US); Joseph Hayden Miller, Jr., Lafayette, LA (US)

(73) Assignee: Devin International, Inc., Lafayette, LA (US)

( * ) Notice: Subject to any disclaimer, the term of this patent is extended or adjusted under 35 U.S.C. 154(b) by 0 days.

(21) Appl. No.: 10/736,267

(22) Filed: Dec. 15, 2003

(65) Prior Publication Data

US 2005/0129464 A1 Jun. 16, 2005

(51) Int. Cl.[7] ..... B63B 35/44
(52) U.S. Cl. ..... 166/355; 405/224.2
(58) Field of Search . 166/355; 114/264; 405/196–200, 405/221, 195.1, 224, 224.4, 224.2

(56) References Cited

U.S. PATENT DOCUMENTS 2,995,900 A * 8/1961 Hunsucker ..... 405/203
3,421,581 A * 1/1969 Geijn ..... 166/355
RE27,261 E * 12/1971 Bromell et al. ..... 114/264
3,681,928 A * 8/1972 Vincken et al. ..... 405/196
3,918,379 A * 11/1975 McNary et al. ..... 114/264
4,200,054 A * 4/1980 Elliston ..... 114/264
4,362,438 A * 12/1982 Spink ..... 405/195.1
4,557,332 A * 12/1985 Denison et al. ..... 166/345
4,934,870 A * 6/1990 Petty et al. ..... 405/199
5,542,783 A * 8/1996 Pollack ..... 405/223.1
5,846,028 A * 12/1998 Thory ..... 405/195.1
6,343,893 B1 * 2/2002 Gleditsch ..... 405/196

* cited by examiner

*Primary Examiner*—Sunil Singh
(74) *Attorney, Agent, or Firm*—Domingue & Waddell, PLC

(57) ABSTRACT

A system for providing motion compensation of a platform attached to an ocean floor. The platform is operatively associated with a riser extending from a subterranean well. The system comprises a frame member positioned on the platform and a deck slidably attached to the frame member, and wherein the deck is attached to the riser. The system further comprises a moving device for moving the frame member relative to the deck. In one of the preferred embodiments, the frame member contains a plurality of guide post and wherein the deck is slidably mounted on the guide post so that the frame member is movable relative to the deck. The moving device may comprise a cylinder member operatively attached to the frame member and a piston operatively attached to the deck and wherein the system further comprises a pressurized recharging vessel configured to direct a pneumatic supply to the cylinder member, and a gas delivery mechanism for keeping the cylinder member within a pressure range. A method of compensating for movement on an offshore platform during well operations is also disclosed.

18 Claims, 11 Drawing Sheets

MOTION COMPENSATION SYSTEM AND METHOD

BACKGROUND OF THE INVENTION

This invention relates to a structure for compensating motion on an offshore platform. More particularly, but not by way of limitation, this invention relates to a structure and method to compensate for motion of an offshore platform due to tidal, wave, wind and other environmental factors.

In the exploration, drilling and production of hydrocarbons, operators search in remote and exotic areas of the globe. Deep water tracts have been explored and drilled with increasing frequency in recent years. Platforms set in waters of 1,000 to 2,000 feet has become common place, and in some instances, wells have been drilled in water depths of 5,000 feet. Different types of drilling and production platforms have been used in these deep waters. One type of platform is a tension leg platform (TLP). In the TLP, a floating platform is connected to the ocean floor via tendons such as steel cables, as is well understood by those of ordinary skill in the art. Another type of structure used in deep water is the spar platform which generally is a floating cylindrical structure that is anchored to the ocean floor with steel cable means. Other types of floating platforms are known in the art. In deep water, a fixed leg type platform is generally not an option due to the extreme water depths.

In the deep water drilling of subterranean reservoirs, drillers encounter numerous operational problems. For instance, wave conditions may cause a cyclic buoyant force based on the raising, lowering, heaving and pitching of the platform. Also, tidal conditions may cause a variation in platform height and cause similar buoyant forces. The applied forces will in turn cause motion on the platform and on the work deck of the platform. Additionally, the subterranean well that is drilled will have a riser extending from the sea floor to the platform. In other words, a riser extends from the sea floor to the floating platform. As will be understood by those of ordinary skill in the art, the riser generally does not move in unison with the platform since the riser is fixed to the sea floor by different attachment means and the riser does not experience the same buoyant forces as the floating platform.

While an operator is in the midst of performing well work, the motion of the platform can have detrimental effects on the equipment and ongoing operations. For example, a coiled tubing unit that is rigged-up and running a string of tools into the well could be lifted upward and/or downward due to the motion of the platform. This motion could potentially cause serious damage such as breaking the connection of the coiled tubing to the riser which in turn could lead to a catastrophic failure. With prior art designs, operators find it necessary to stop operations and rig down the connection and then reconfigure. Thus, there is a need for a system and method that can compensate for motion of a floating platform while undergoing well intervention procedures. This need, and many other needs, will be fulfilled according to the teachings of the present invention.

SUMMARY OF THE INVENTION

A system for providing motion compensation of a platform attached to an ocean floor is disclosed. The platform is operatively associated with a riser extending from a subterranean well. The system comprises a frame member positioned on the platform and a deck slidably attached to the frame member, and wherein the deck is attached to the riser. The system further comprises means for moving the frame member relative to the deck.

In one of the preferred embodiments, the frame member contains a plurality of guide post and wherein the deck is slidably mounted on the guide post so that the frame member is movable relative to the deck.

Also in one of the preferred embodiments, the moving means comprises a cylinder member operatively attached to the frame member and a piston operatively attached to the deck and wherein the system further comprises energizing means for energizing the cylinder member so that the cylinder member extends from the piston thereby moving the frame member.

In a preferred embodiment, the energizing means comprises a pressurized (recharging) vessel configured to direct a pneumatic supply to the cylinder member and, valve panel for regulating the pressure delivered to the cylinder member. The energizing means may include a gas delivery mechanism for keeping the cylinder member within a predetermined pressure range and wherein a pressure circuit connects the gas delivery mechanism to the cylinder member. The moving means may further comprise a second cylinder member, and a second piston operatively associated with the second cylinder member.

The system may further comprise a track stacker member that is attached to the deck, and an injection head operatively attached to the track stacker member and wherein the frame member is positioned on the floating platform. In one of the embodiments, a coiled tubing is disposed within the injection head, and wherein the coiled tubing extends into the well.

The frame member may further comprise a spacer and wherein the spacer is attached to a floating platform in an ocean. In this way, various spacer sections may be included in order to obtain the desired working height from the floating platform.

Also, the system may further contain a means for locking the deck to the frame in order to prevent movement of the deck. In one preferred embodiment, the locking means is a pneumatic cylinder with engaging pin for engaging with a latching beam attached to the frame.

A method of compensating for movement on an offshore platform during well operations is also disclosed. The method comprises providing a motion compensator on the offshore platform. The motion compensator comprises a frame member attached to the platform, and a deck slidably mounted on the frame member. The method further comprises attaching the deck to a riser that extends from the well to the platform, moving the offshore platform in a first vertical direction, and then sliding the frame member relative to the deck.

In one embodiment, the motion compensator further comprises a cylinder connected to the frame member, with the cylinder having a piston disposed partially therein. The piston is attached to the deck and wherein the cylinder is responsive to a pressure. The step of sliding the frame member comprises controlling the pressure into the cylinder with an energizing pressure means to the cylinder and absorbing any force associated with the movement of the offshore platform.

In one of the preferred embodiments, an injector head is attached to the deck and wherein the injector head receives a coiled tubing, and the method further comprises lowering the coiled tubing into the riser and performing well work on the well with the coiled tubing.

In one of the preferred embodiments, the pressure within the cylinder is set a predetermined balanced pressure and the step of controlling the pressure into the cylinder with an energizing pressure means includes moving the cylinder in a downward direction in response to sea movement, increasing the area within the cylinder which in turn decreases the pressure within the cylinder. A gas is directed into the cylinder so that the pressure within the cylinder increases until the predetermined balanced pressure is reached.

In the event the cylinder moves in an upward direction in response to sea movement so that the area is decreased within the cylinder, pressure would be increased within the cylinder. Hence, gas would be directed from the cylinder so that the pressure within the cylinder decreases, and ultimately, the pressure is decreased to the predetermined balanced pressure.

An advantage of the present invention is that the system and method can be used on floating platforms. Another advantage is that the system and method provides for motion compensation on a well undergoing well intervention and remedial well work. Still yet another advantage is that the present invention allows for performing coiled tubing well work safely.

A feature of the present invention includes the modular design of the components. The modularity allows for ease of transportation, delivery and rig up. Yet another feature includes the ability to build the height needed on specific well applications by simply stacking spacers one on top of the other.

Another feature is that motion compensation is provided in the vertical direction. Yet another feature is the pressure control means that regulates the pressure to the cylinders. Still another feature is the use of the plurality of posts that guide the frame structure with respect to the deck during movement of the platform.

DETAILED DESCRIPTION OF THE PREFERRED EMBODIMENTS

Figure 1A:
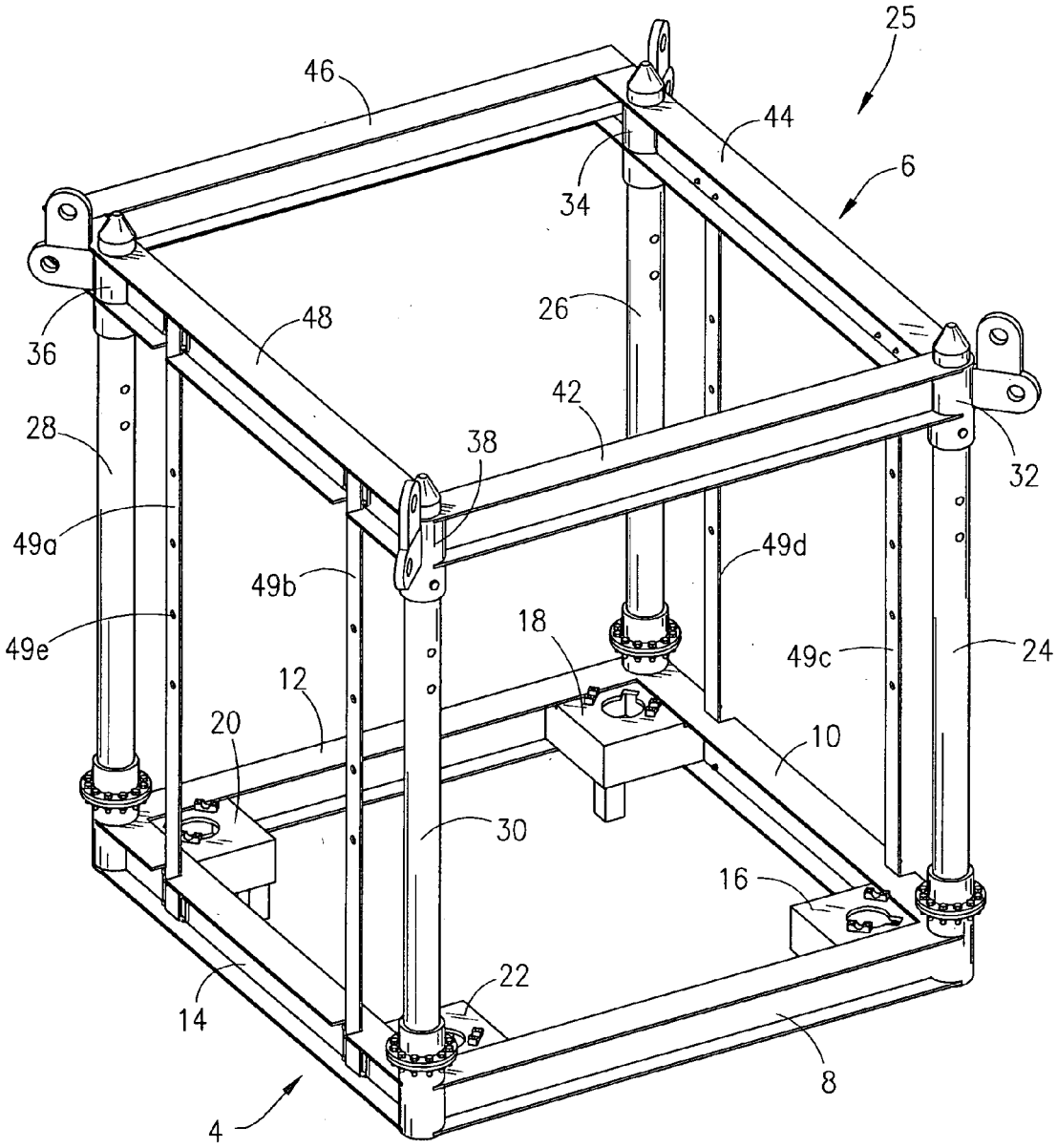
FIG. 1A is an isometric view of the frame member of the present invention.

Referring now to FIG. 1A, an isometric view of the frame member 25 that includes the base support member 4 and the top support member 6 of the present invention shown in a first position. The support member 4 is rectangular member that has four sides namely a first beam 8, second beam 10, third beam 12 and fourth beam 14. At the corners of support member 4 are attachment plates, namely attachment plate 16, attachment plate 18, attachment plate 20 and attachment plate 22. The base support member 4, top support member 6 and associated connecting beams is referred to as the frame member 25.

FIG. 1A shows that extending from the corner of beams 8, 10 is the post 24; extending from the corner of beams 10, 12 is the post 26; extending from the corner of beams 12, 14 is the post 28; and, extending from the corner of beams 8, 14 is the post 30. The post 24 is disposed through the collar 32; the post 26 is disposed through the collar 34; the post 28 is disposed through the collar 36; and, the post 30 is disposed through the collar 38. The top support member 6 is a rectangular member that consist of a first beam 42, second beam 44, third beam 46 and fourth beam 48. The beam 42 is connected to the collar 32 and 38; the beam 44 is connected to the collars 32, 34; the beam 46 is connected to the collars 34, 36; and, beam 48 is connected to the collars 36, 38 as shown. The beams are connected to the collars via conventional means such as welding, nuts and bolts, pins, etc. The top support member 6 is connected to the posts via conventional means such as welding, by nuts and bolts, pins, etc. FIG. 1A further shows latching beam 49*a*, 49*b*, 49*c*, 49*d*, and wherein the latching beams 49*a*, 49*b*, 49*c*, 49*d* have openings there through, for instance opening 49*e*.

Figure 1B:
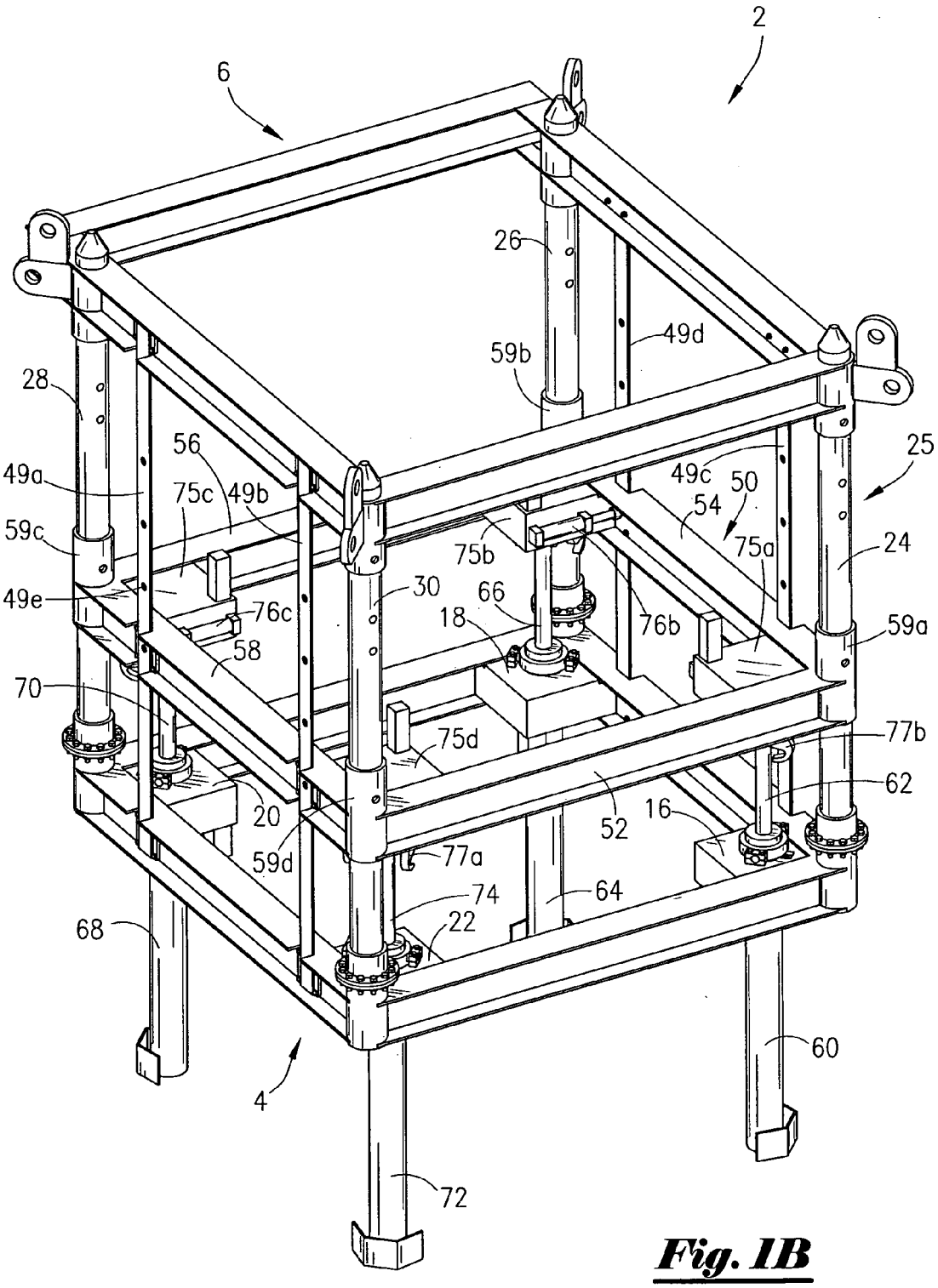
FIG. 1B is an isometric view of the motion compensation structure that includes the frame member and associated deck of the present invention shown in a first position.

Referring now to FIG. 1B an isometric view of the motion compensator structure 2 that includes the frame member 25 and associated deck 50 will now be described. It should be noted that like numbers appearing in the various figures refer to like components. The motion compensation structure 2 includes the deck 50 that is slidably disposed on the post 24–30. More specifically, the deck 50 is rectangular with a first beam 52, second beam 54, third beam 56, and fourth beam 58, and wherein at each corner is a collar that will have disposed there through the respective post. Hence, the collar 59*a* has post 24 there through; collar 59*b* has post 26 there through; collar 59*c* has post 28 there through; and, collar 59*d* has post 30 there through. The collars are attached to the beams via conventional means such as by welding, nuts and bolts, pins, etc.

The attachment plate 16 has operatively attached a pressure cylinder 60 with a piston disposed therein and wherein a piston stem 62 extends from the pressure cylinder 60, and wherein the stem 62 is attached to the deck 50. The attachment plate 18 has operatively attached a pressure cylinder 64 with a piston disposed therein and wherein a piston stem 66 extends from the pressure cylinder 64 and wherein the stem 66 is attached to the deck 50. The attachment plate 20 has operatively attached a pressure cylinder 68 with a piston disposed therein and wherein a piston stem 70 extends from the pressure cylinder 68 and wherein the stem 70 is attached to the deck 50. The attachment plate 22 has operatively attached a pressure cylinder 72 with a piston disposed therein and wherein a piston stem 74 extends from the pressure cylinder 72 and wherein the stem 74 is attached to the deck 50. As seen in FIG. 1B, piston stem 62 is connected to the attachment plate 75*a* of deck 50, piston stem 66 is connected to the attachment plate 75*b* of deck 50, piston stem 70 is connected to the attachment plate 75*c* of deck 50, and piston stem 74 is connected to the attachment plate 75*d* of deck 50.

FIG. 1B further shows attachment plates 75*a*–75*d* will have operatively attached locking cylinders with engagement pins. FIG. 1B shows cylinder 76*b* and 76*c*. Cylinder 76*c* will extend the engagement pin (not shown here) that will engage the opening 49*e* of latching beam 49*a*, thereby locking the deck 50 so that movement would be prevented. Hence, during maintenance and other remedial activity, the deck can be locked and prevented from movement. This feature will described in greater detail later in the application.

FIG. 1B also shows the hook members attached to deck 50, and more specifically the hook member 77*a* and hook member 77*b* are shown. The hook members will attach to a reciprocal pin member located on the cylinder. The pin members are located on the attachment plates 16, 18, 20, 22. By latching hooks to the pins, the deck can be prevented from movement. Hence, during maintenance and other remedial activity, the deck can be locked and prevented from movement. This feature will also be described in greater detail later in the application.

Figure 1C:
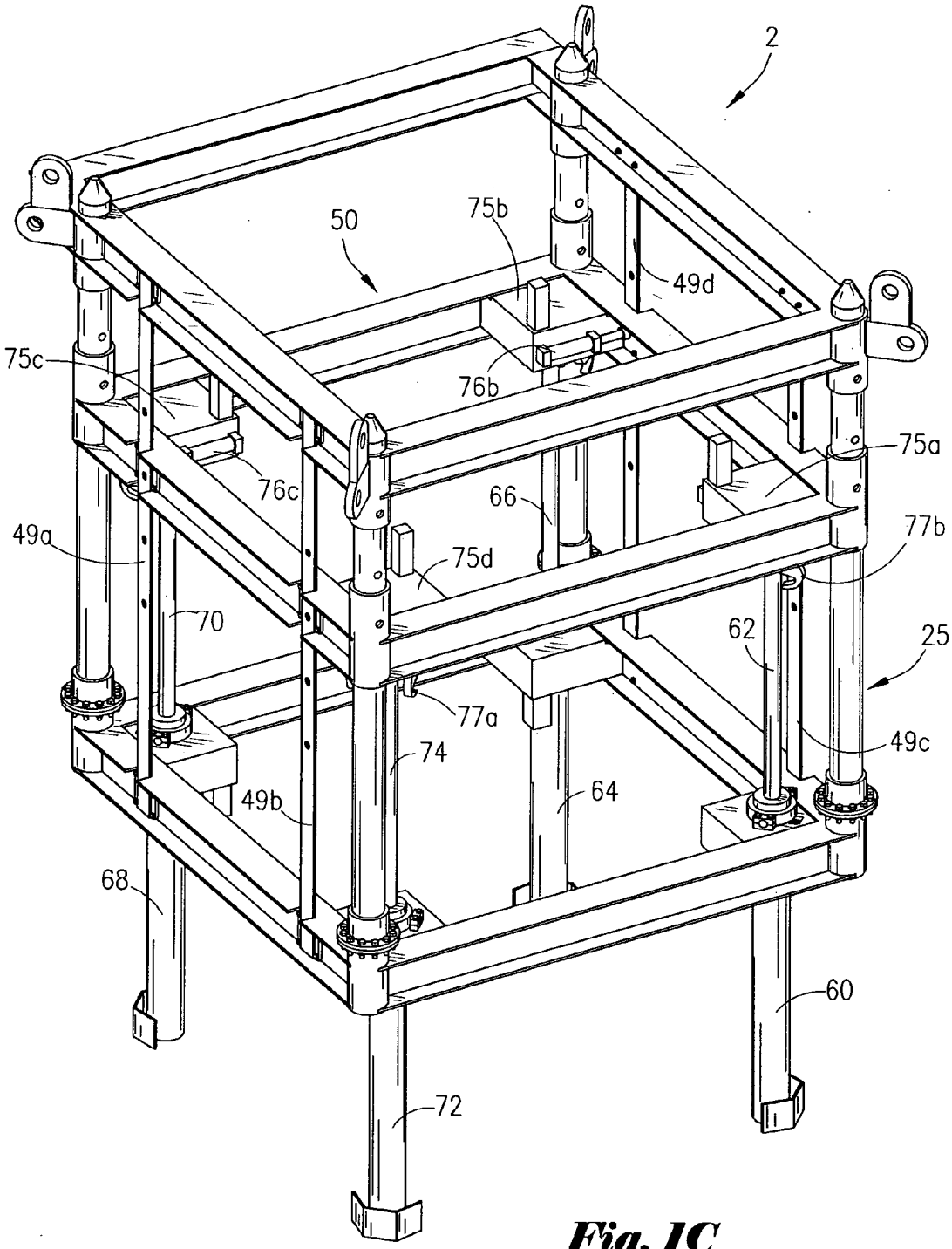
FIG. 1C is the motion compensation structure of FIG. 1B wherein the frame member is shown moved to a second position.

Referring now to FIG. 1C, the motion compensation structure 2 of FIG. 1B is shown and wherein the frame member 25 is shown moved to a second position relative to the ocean floor, as will be more fully explained later in the application. The level of deck 50 is at the same height in FIG. 1B as it is in FIG. 1A. In other words, deck 50 is the same height relative to the sea floor, but the frame member 25 has moved relative to the deck 50. The reason that the frame member 25 has moved is due to wave and/or tidal movement of the ocean wherein the frame member 25 has slide downward on the guide post. As seen in FIG. 1C, the piston stems 62, 66, 70 and 74 are extended. The deck 50 is held in an essentially stationary position relative to the sea floor during operation, as will be explained later in the application.

Figure 2:
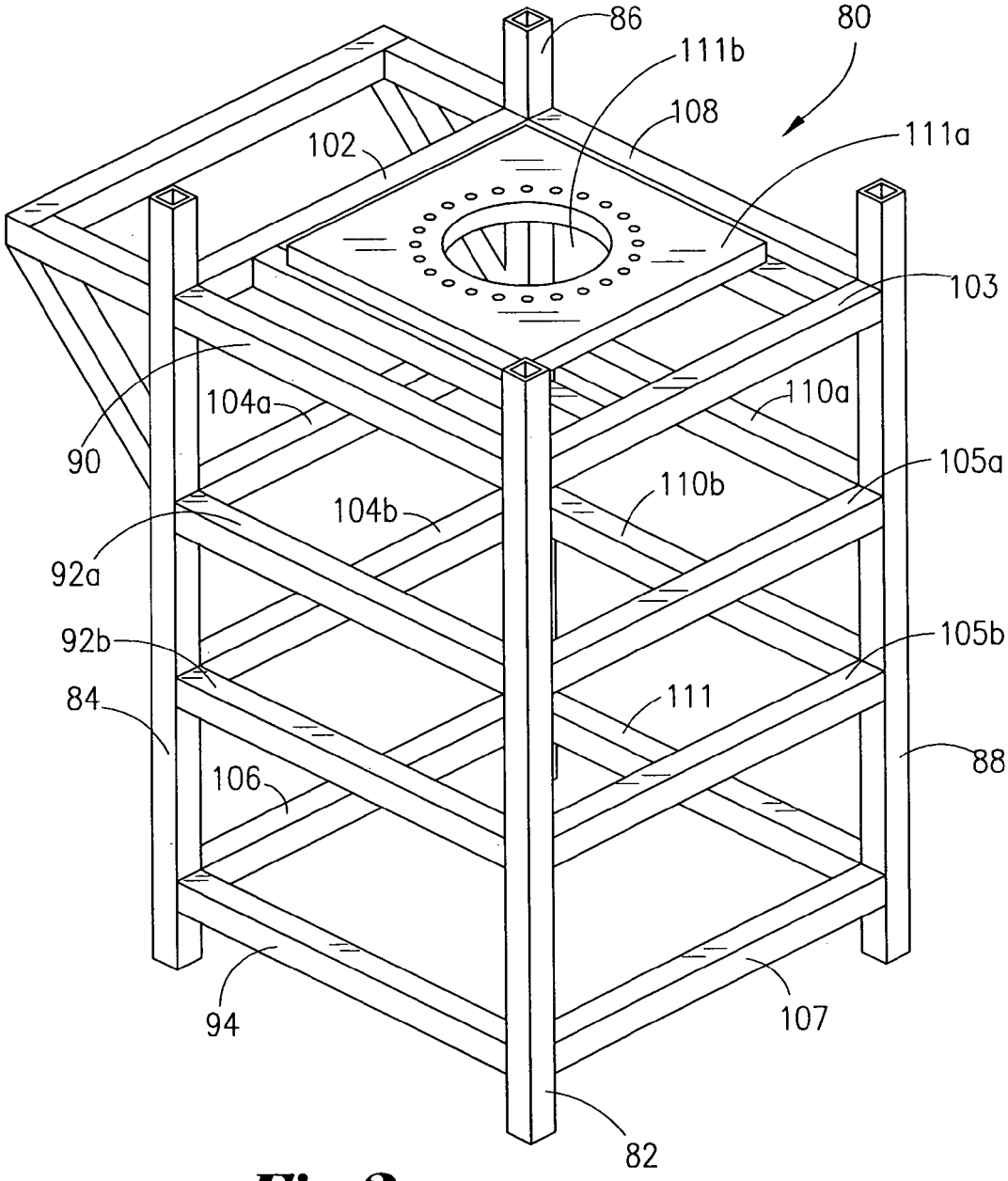
FIG. 2 is an isometric view of the track stack structure that is used in conjunction with the motion compensation structure of FIGS. 1B and 1C.

FIG. 2 is an isometric view of the track stack structure 80 that is used in conjunction with the motion compensation structure 2 of FIGS. 1B and 1C. The track stack structure 80 is commercially available from Devin International, Inc. under the name Track Stack Jr. The track stack structure 80 is in the form of a rectangular cube and consist of a first leg 82, second leg 84, third leg 86, and fourth leg 88. An upper beam 90 intermediate beams 92*a*, 92*b*, and lower beam 94 connects the legs 82 and 84. Other members, such as diagonal members, can be added for structural support. An upper beam 102, intermediate beams 104*a*, 104*b*, and lower beam 106 connects the pilings 84 and 86. The upper beam 108, intermediate beam 110*a*, and lower beam 110*b* connects the pilings 86 and 88. The upper beam 103, intermediate beams 105*a*, 105*b* and lower beam 107 connects pilings 82, 88. Also, the table 111*a* is shown, and wherein the table 111*a* is attached to the track stack structure 80, and generally to beams 90, 102, 103, 108.

The table 111*a* has the opening 111*b* through which will be disposed the riser. In the most preferred embodiment, the table 11*a* can then be attached to an injector head for coiled tubing, and the injector head is attached to the riser thereby in effect attaching the deck 50 to the riser. The means for attaching includes nuts and bolts, welding, pinning systems, etc, which are all very well known in the art.

Figure 3A:
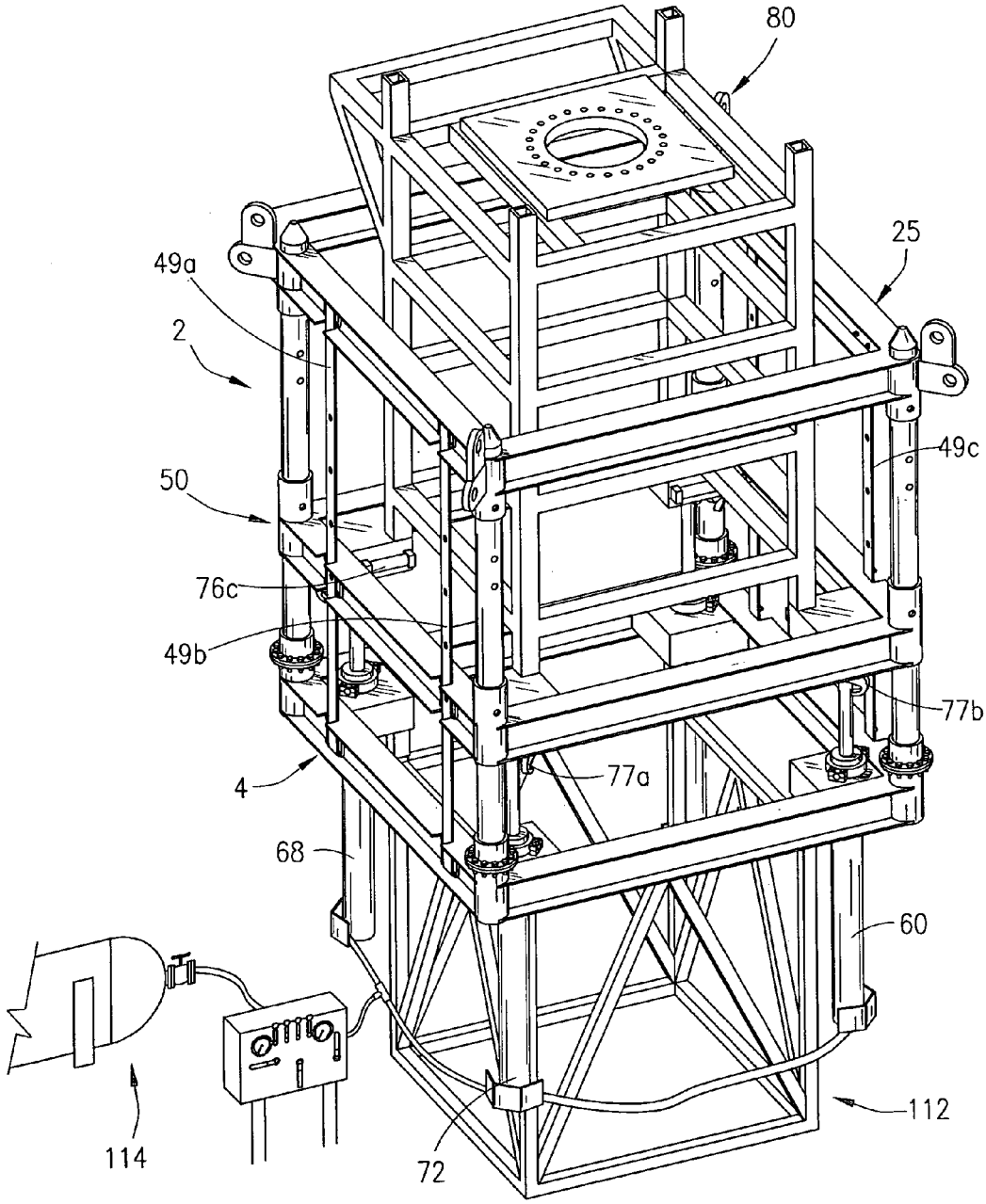
FIG. 3A is the assembly of the motion compensation structure and track stack structure shown in a first position.

FIG. 3A is the assembly of the motion compensation structure 2 and track stack structure 80 shown in a first position. FIG. 3A additionally depicts a spacer structure 112, and wherein the spacer structure 112 is a rectangular cube configured structure similar to the track stack structure 80. The spacer structure 112 is connected to the frame member 25, and more specifically, spacer structure 112 is connected at the top end to the base support member 4 via conventional means such as welding, nuts and bolts, pins, etc.

The spacer structure 112 is modular, and therefore, a number of spacer structures can be stacked one on top of the other, depending on the height required. In other words, different platforms, or perhaps different wells on a platform, may require different working heights. The modular design allows the stacking of these spacer structures to meet the specific requirements for the well intervention work, as will be understood by those skilled in the art.

Additionally, FIG. 3A schematically shows the pressure control means 114 for controlling the pressure contained within the pressure cylinders 60, 64, 68, and 72. The pressure control means 114 regulates the pressure based on a measured amount of pressure within the cylinders 60, 64, 68, 72. The pressure control means 114 will be discussed in greater detail in the discussion of FIGS. 4A and 4B.

Figure 3B:
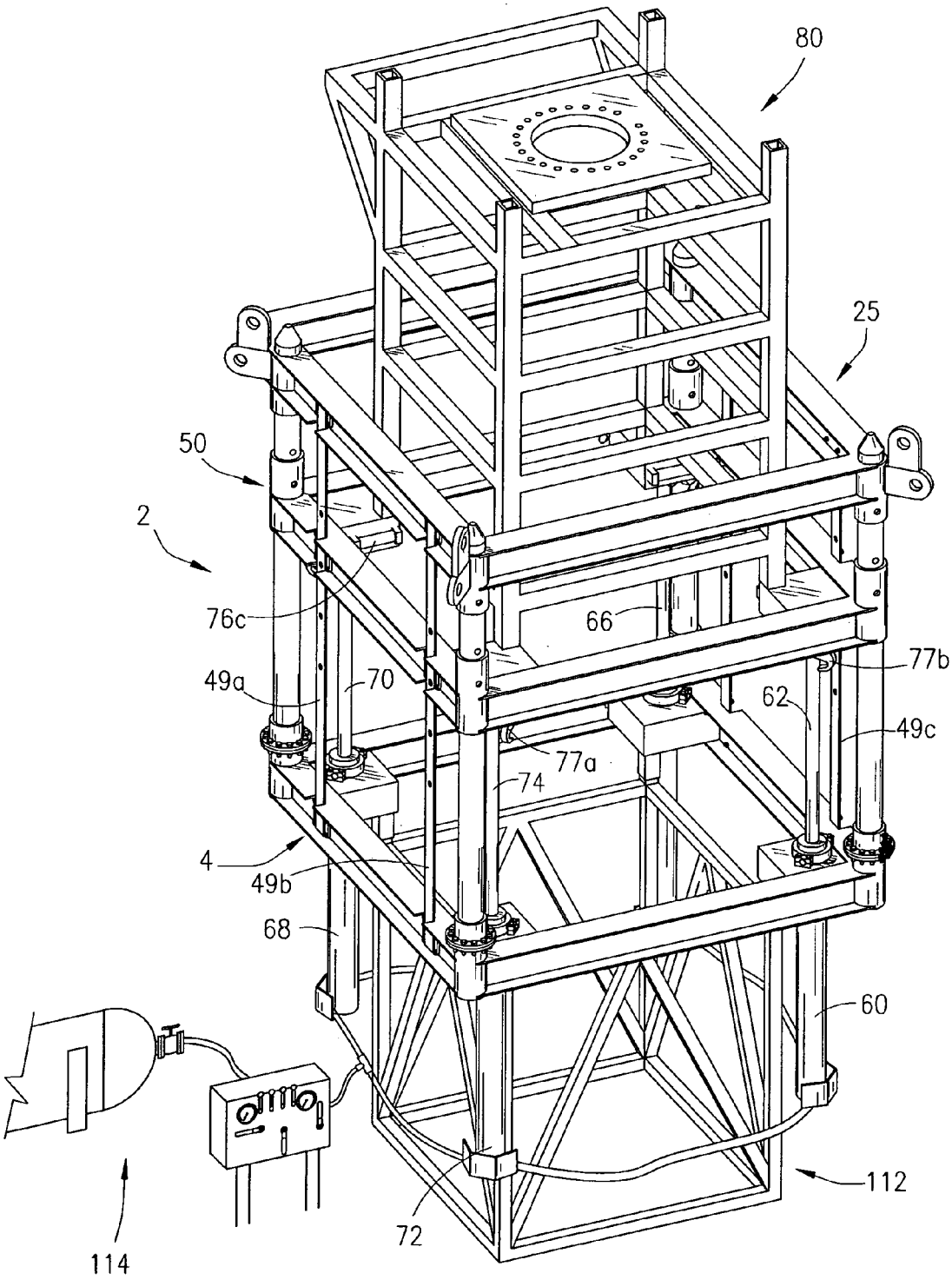
FIG. 3B is the assembly of the motion compensation structure and track stack structure shown in a second position.

FIG. 3B is the assembly of the motion compensation structure 2 and track stacker member 80 shown in a second position. As seen in FIG. 3B, the piston stems 62, 66, 70 and 74 are extended due to the downward movement of the platform, as will be explained later in the application. As noted earlier, the track stack structure 80 is attached to the deck 50 and the riser, as will be more fully explained later in the application. According to the teachings of this invention, the motion compensator 2 responds to ocean wave or tidal movement by way of the control means 114. In the event of wave and/or tidal movement, as noted earlier, the height of the frame member 25 would change. Hence, by controlling the pressure in the cylinders 60, 64, 68 and 72, movement of the platform can be compensated thereby reducing the tension that would be applied between the track stacker structure 80 and the riser.

Figure 4A:
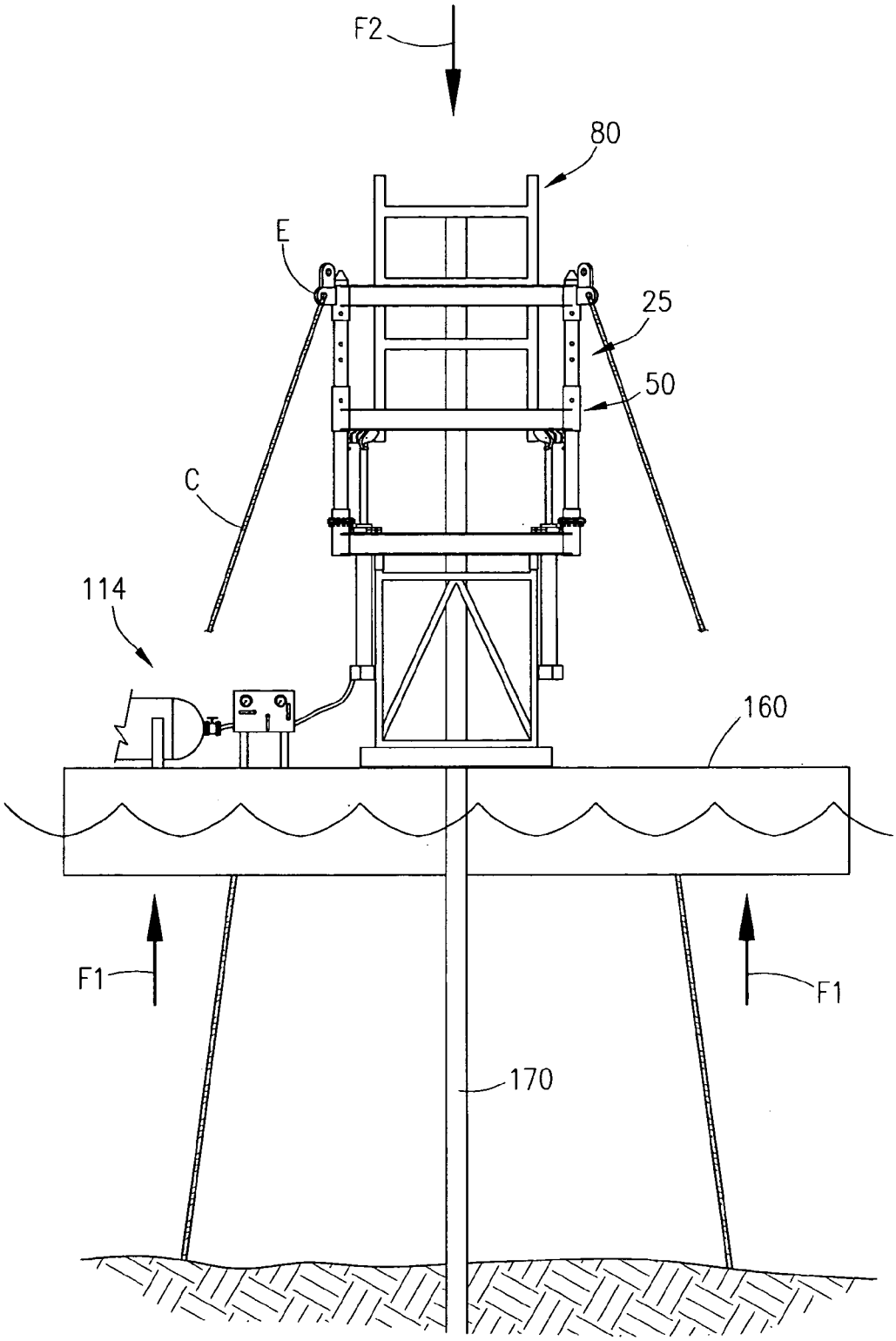
FIG. 4A is a schematic illustration of the forces imposed on the floating platform.

FIG. 4A is a schematic view of the forces being applied to the system herein described. Hence, the floating platform 160 is being subjected to an upward buoyant force F1 by the ocean while the track stacker structure 80 subjects a downward gravitational force, due to the weight of structure 80, denoted by F2. In the most preferred embodiment, the deck 50 will be positioned with an upward stroke of approximately three feet relative to the frame member 25 and a downward stroke of approximately three feet relative to the frame member 25. The control means 114, which will be described with reference to FIG. 4B, allows the operator to maintain a pressure and uplift/tension balanced state between the track stack structure 80 and the frame member 25 during wave and tidal movement while at the same time maintaining a three foot stroke, from the mid position, in an upward or downward vertical direction. FIG. 4A also shows the pad eyes E for attaching a support cable C to the structure for support during operations.

Figure 4B:
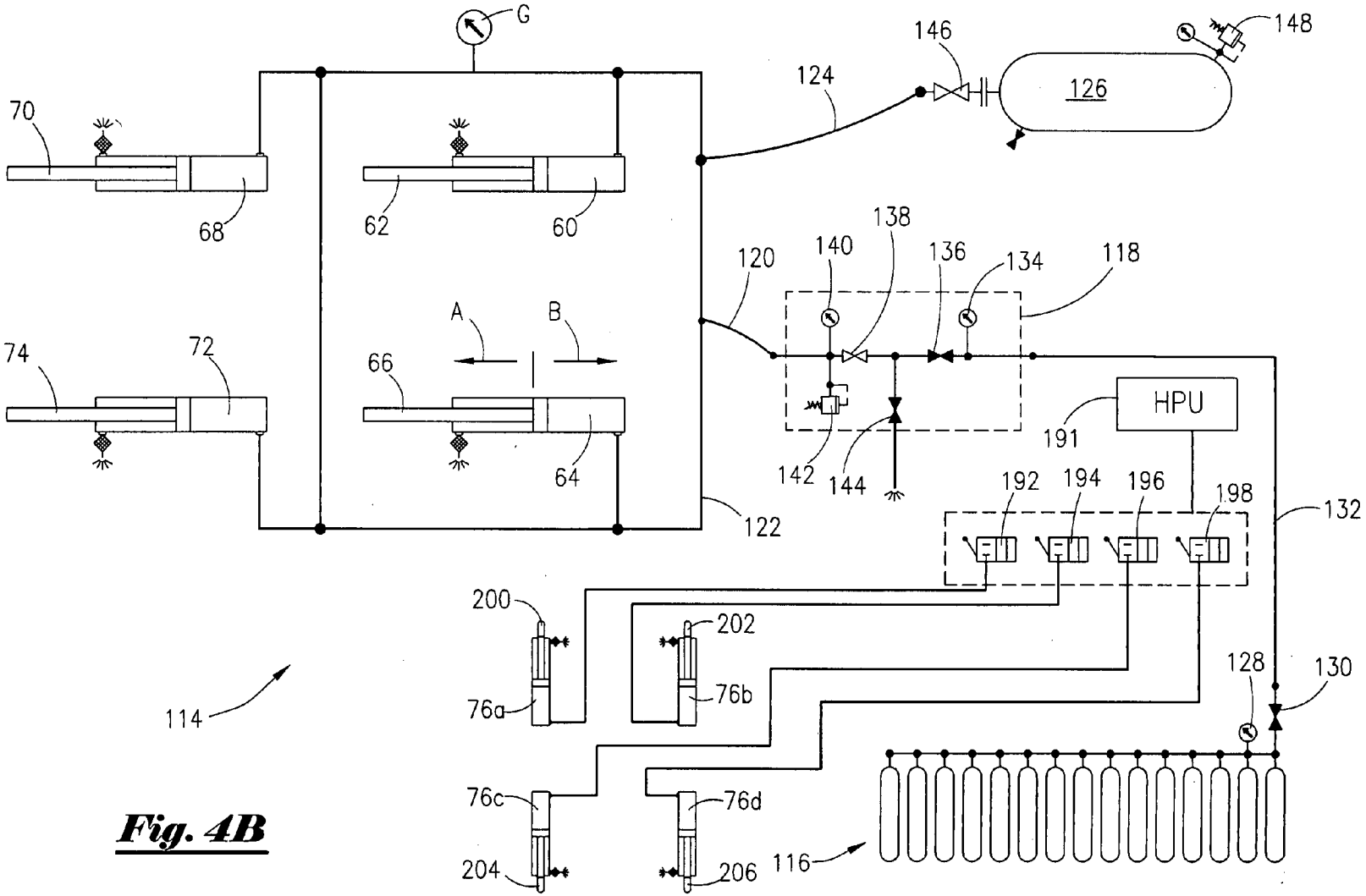
FIG. 4B is a schematic illustration of the control means of the present invention.

FIG. 4B, which is a schematic illustration, depicts the control means 114 of the present invention. In the most preferred embodiment, a reservoir 116 of nitrogen or air pressure filled tanks, or a similar compressed air supply, is connected to the valve panel 118 and wherein the valve panel 118 regulates the amount of pressure that will be directed into the cylinders 60, 64, 68, 72 thereby adjusting the effective upward force and length of exposed pistons stems of the main cylinders 62, 66, 70, 74. Hence, the pressure is directed from the valve panel 118 via line 120 to the pressure circuit which includes the pneumatic line 122 hose 124 and pressure expansion vessel 126, which in turn directs the pressure to the cylinders 60, 64, 68, 72. As used herein, the pressure circuit includes hose 124, vessel 126, pneumatic line 122, cylinder 68, cylinder 72, cylinder 64, cylinder 60. The reservoir 116 and valve panel 118 acts to charge the pressure circuit with a predetermined minimum pressure setting in order to keep the system in a balanced state.

The vessel 126 is connected to the pneumatic line 122 via hose 124. The vessel 126 acts as a reservoir to collect and transfer pressure from the pressure circuit during operation. It should be noted that the pressure circuit will be set at a balanced pressure state i.e. the pressure necessary to support the weight. In the most preferred embodiment, the pressure within the pressure circuit will be set to allow some additional over tension/pressure so that there is an operating range of pressure within the cylinders 60, 64, 68, 72.

In operation, the control means 114 either directs pressure to the pressure circuit (including hose 124, vessel 126, line 122, cylinder 60, cylinder 64, cylinder 68, cylinder 72) or directs pressure from the pressure circuit (including hose 124, vessel 126, line 122, cylinder 60, cylinder 64, cylinder 68, cylinder 72) in order to maintain a predetermined upward pressure/force balanced state. The change in position of the cylinders effects the pressure within the cylinders which in turn dictates if pressure should be directed to the cylinders or directed from the cylinders.

As noted earlier, the cylinders and pistons have a predetermined extension distance based on a balanced pressure state. This predetermined extension distance allows a stroke distance of either three feet upward or three feet downward. For example, the track stack structure 80 has some specific weight without any outer forces applied thereto, and the cylinders, which are attached to the floating platform, will have a predetermined buoyant force applied thereto, as was shown in FIG. 4A. Referring again to FIG. 4B, the pressure circuit, and in particular cylinders 60, 64, 68, 72 are charged to a predetermined pressure to keep the cylinders extended in this balanced state. The track stack structure 80 is attached to the sea floor via the riser 170 and wherein a three foot stroke in an upward direction (see line A) and a three foot stroke in a downward direction (see line B) is allowed while operating within the predetermined balanced state. In effect, the pressure control means 114 acts as a shock absorber (or motion compensator) to the various forces applied during the operation. It should also be noted that biasing means for biasing the cylinders up and down are also possible. Examples of biasing means includes coiled springs contained within the cylinders and about the pistons.

A gauge G measures the pressure within the system. In the case where tidal or ocean movement causes the platform to lower, the cylinders would be expanded thereby increasing the cylinder volume which in turn decreases the pressure within the cylinders. In order to maintain the balanced state, pressure from vessel 126 would automatically be applied to the cylinders via hose 124 and valve 146. This will reestablish the pressure to its balanced state, the downward force applied by the track stack structure 80 is again in equilibrium with a stroke of three feet minus the small drop in overall pressure and force. If pressure were not allowed to increase, the frame member 25 would lower. In the practical application, the control means 114 allows the ability to move upward or downward somewhat thereby decreasing the tension between the frame member 25 and the deck 50 (remember, the deck 50 is in effect connected to the riser).

If the tidal or ocean movement causes the platform to rise, then the cylinder area is decreased which in turn would cause a pressure increase. In order to maintain the balanced state, pressure from the cylinders can be directed to the vessel 126 automatically via hose 124 and valve 146. This will reestablish the pressure to its balanced state while at the same time decreasing the compressive force between the frame member 25 and the deck 50.

Regarding the nitrogen filled tanks 116, in one of the preferred embodiments, there are 12 or more nitrogen bottles positioned on a rack with a manifold. As noted earlier, the tanks 116 are used to recharge the pressure circuit if the balanced pressure state falls below a predetermined threshold. A gauge 128 is positioned in order to sample the pressure. A ball valve 130 is positioned in the line 132, wherein the ball valve 130 controls the pressure input to the control panel 118; in normal operation, the valve 130 is closed. With respect to the control panel 118, the control panel 118 includes a pressure gauge 134 for reading the pressure in input line 132, a ball valve 136 that will then connect to a ball valve 138 that leads to the line 120. Valve 136 is open and valve 138 is opened for charging the system only. Under normal operation both valves are closed in order to create a redundant sealing of the pressure in the system. A pressure gauge 140 is also included upstream of the ball valve 138 for system operational pressure reading. Also included in one of the preferred embodiments is the relief valve 142 which may be set, for instance, at 1000 psi, in order to release pressure at a predetermined set point determined by the operator as exceeding a safety threshold. FIG. 4B also depicts that the control panel 118 can contain the ball valve 144 for releasing pressure if found desirable by the operator; valve 144 would normally be closed.

The vessel 126 will have the ball valve 146 associated with the line 124, as well as the pressure relief valve 148 that can be set at a predetermined threshold pressure of 900 psi in order to relieve any build up in pressure above that amount, as will be understood by those of ordinary skill in the art. In normal operations, valve 146 is open so that the pressure within the pressure circuit communicates with the vessel 126.

FIG. 4B also depicts the hydraulic system for locking means. More specifically, a hydraulic power unit 191 directs hydraulic fluid to valve 192, valve 194, valve 196, and valve 198. The valve 192 directs pressure to cylinder 76*a*; valve 194 directs pressure to cylinder 76*b*; valve 196 directs pressure to cylinder 76*c*; and, valve 198 directs pressure to cylinder 76*d*. Once pressure is supplied to the cylinders, a pin will extend therefrom and engage with the latching beams in order to lock the deck relative to the frame member, as previously described. Thus, pressure supplied to cylinder 76*a* extends pin 200; pressure supplied to cylinder 76*b* extends pin 202; pressure supplied to cylinder 76*c* extends pin 204; and, pressure supplied to cylinder 76*d* extends pin 206. Although not shown, it is possible to energize the locking means utilizing the pneumatic system, rather than hydraulics; the pneumatic energizing means would use nitrogen tanks 116.

Figure 5B:
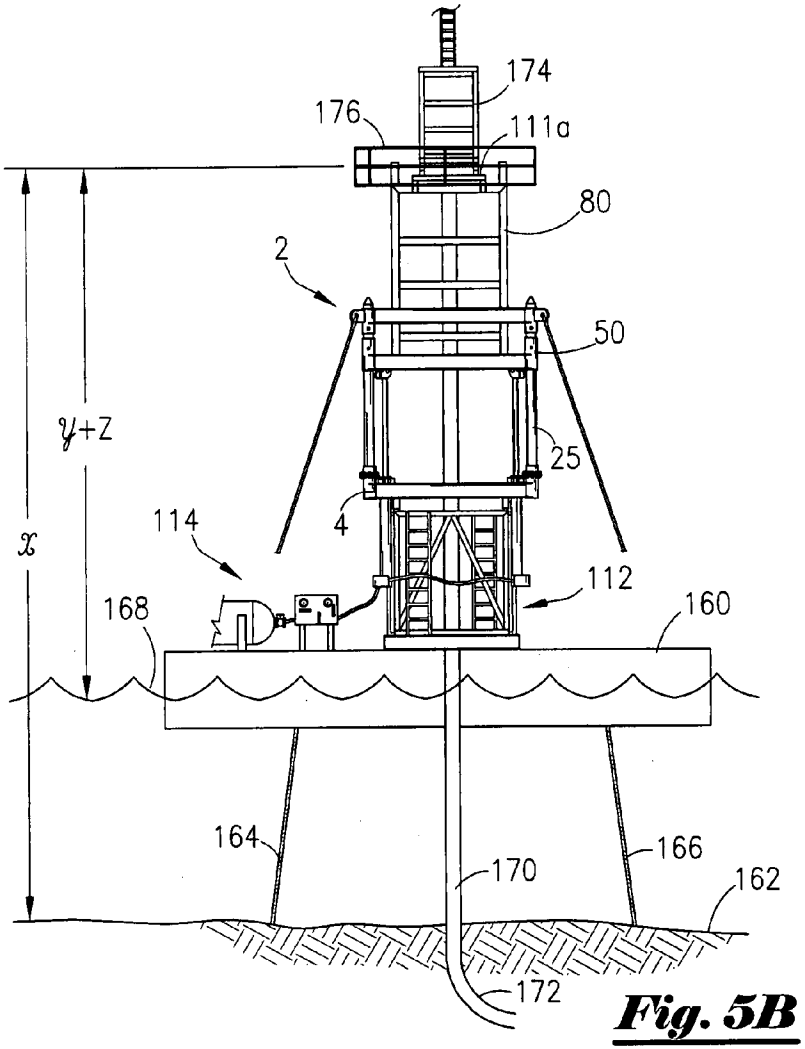
FIG. 5B is the elevation view of FIG. 5A wherein the motion compensation structure has compensated due to sea movement.
Figure 5A:
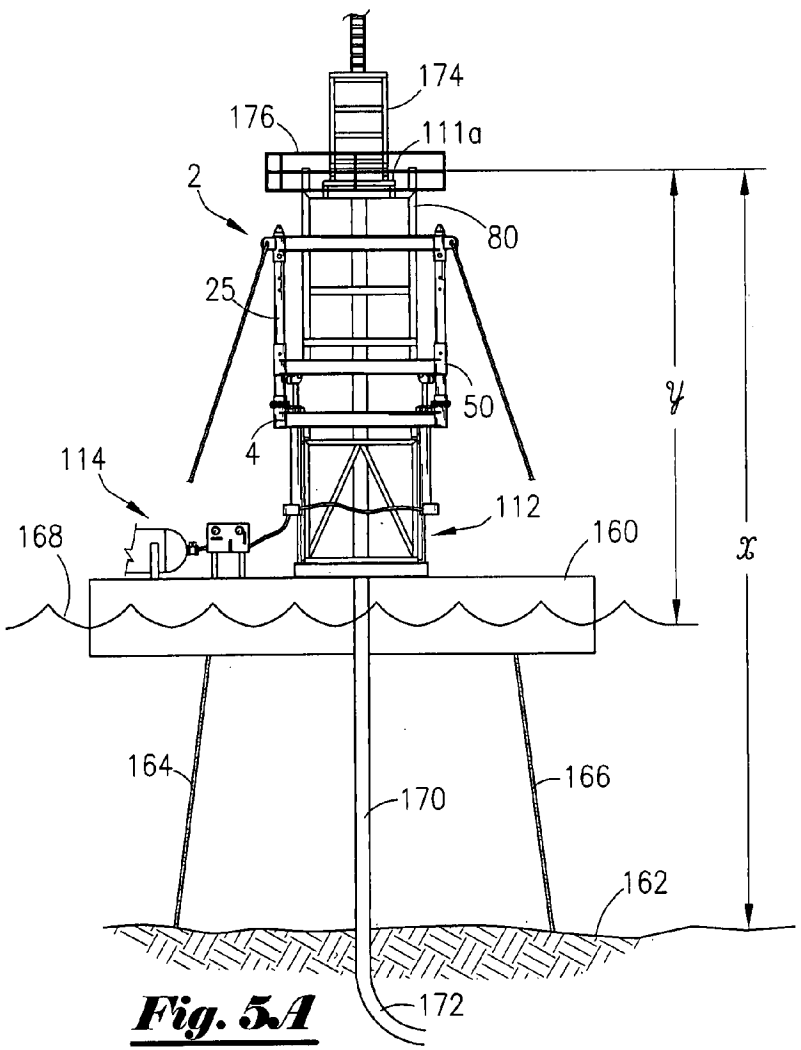
FIG. 5A is an elevation view the motion compensation structure situated on a platform.

FIG. 5A is an elevation view of the motion compensation structure 2 positioned on a tension leg type of platform 160. The tension leg platform 160 has a plurality of attachment means for attaching the platform 160 to the sea floor 162. FIG. 5A depicts the steel cables 164, 166 that have been anchored to the sea floor 162 at a first end, and attached to the platform 160 at a second end. The surface of the sea is denoted at 168. It should be noted that the present invention is applicable to any type of platform where height variation relative to the sea floor is a factor in operations. Thus, the invention is also applicable to spar platforms, drill ships, and semi-submersible rigs, etc.

As seen in FIG. 5A, a riser 170 extends from the sea floor 162 through the platform 160. The riser 170 extends from a well 172 that is drilled to a subterranean reservoir as will be understood by those of ordinary skill in the art. The riser 170 will be connected to the track stack structure 80 via the table 11*a*. As noted earlier, the track stack structure 80 is attached to the deck 50. An injector head 174 such that is used on coiled tubing installations is shown along with a cat walk 176 that surrounds the top of the track stacker structure 80. The injector head 174 is used to direct the coiled tubing into the well 170 as is well understood by those of ordinary skill in the art.

FIG. 5B is an elevation view of FIG. 5A wherein the motion compensation structure 2 has compensated due to sea movement. The platform 160 may be experiencing, for instance, a significant wave. In FIG. 5A, note that the height of the injector head 174 relative to the sea floor 162 is X, while the height from the injector head 174 to the water level is Y. In FIG. 5B, the platform 160 has lowered relative to the sea floor 162. Hence, the distance from the sea floor 162 to the injector head 174 is still X, however, the distance from the injector head 174 to the sea level has increased to Y+Z due to the sea and/or tidal movement. Hence, the pressure gauge G (as seen in FIG. 4B) will show a decrease in pressure since the volume in the cylinders is decreasing but the pressure will remain within the balanced state range due to the ability of the pressure circuit to communicate with the vessel 126.

Note that in the case wherein the platform 160 is rising (which is seen in FIG. 5A), then the area within the cylinders will decrease thereby increasing the pressure within the cylinders due to the decrease in cylinder volume but the pressure will remain within the balanced state range due to the ability of the pressure circuit to communicate with the vessel 126.

Figure 6:
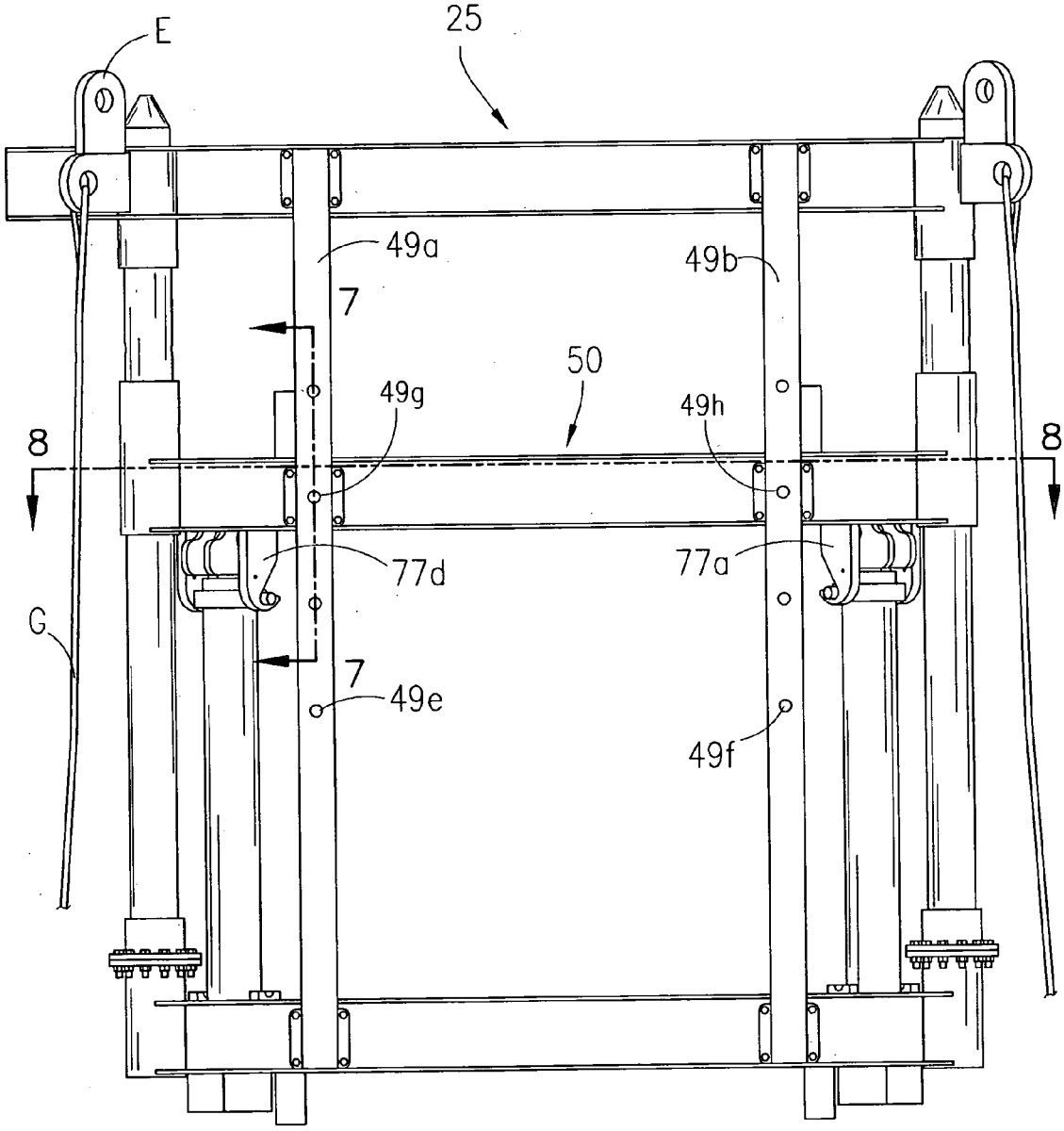
FIG. 6 is a partial side view of FIG. 1B.
Figure 7:
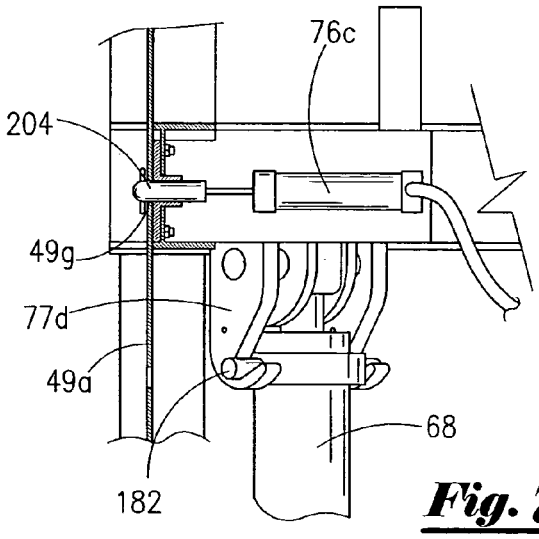
FIG. 7 is a partial cut away view of FIG. 6 depicting the locking cylinder and hook member.
Figure 8:
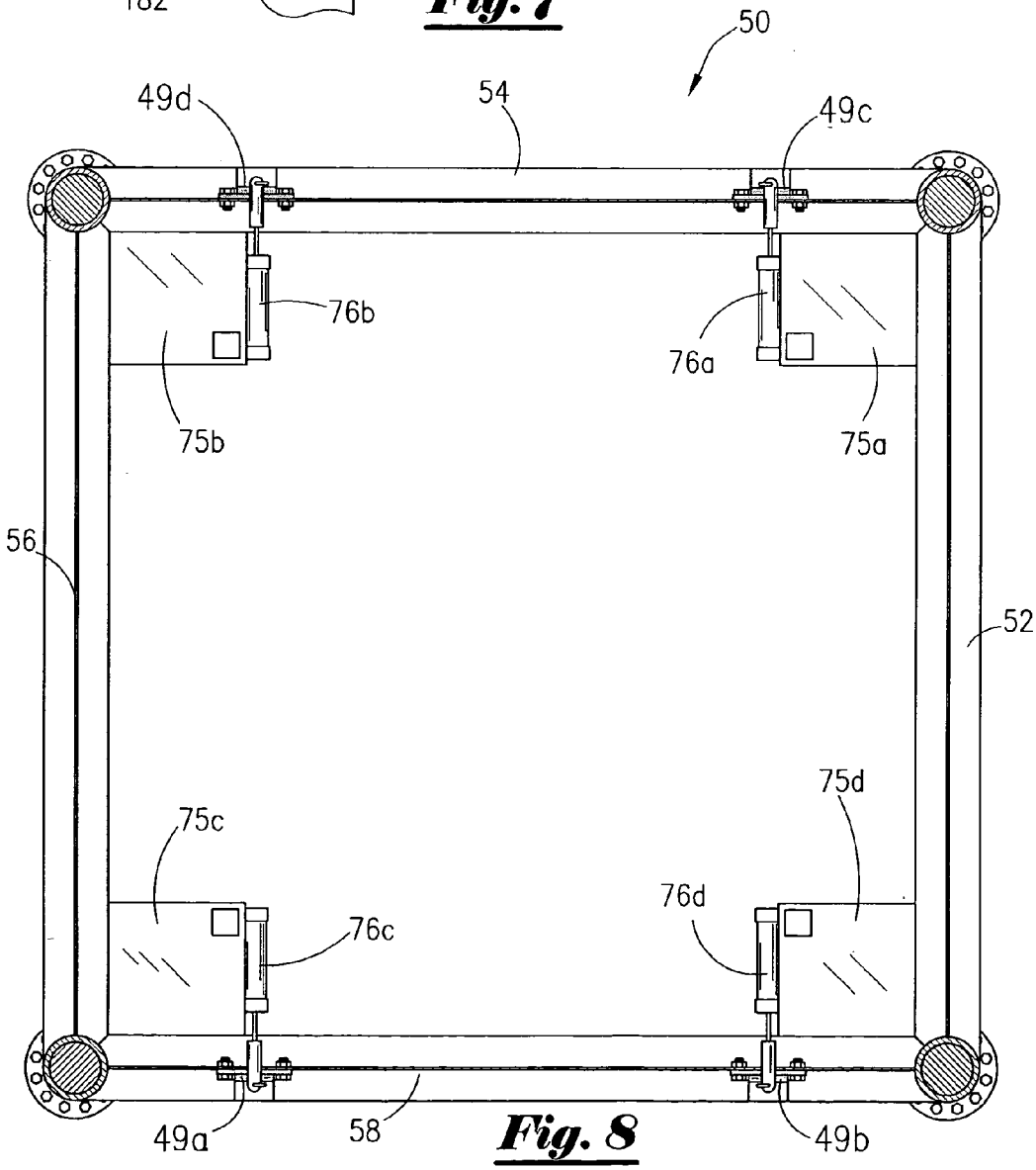
FIG. 8 is a partial cross-section taken along line 8—8 of FIG. 6.

FIGS. 6, 7 and 8 depict the latching cylinder and hook member of the present invention. The latching cylinders and hook member are means for locking the deck 50 relative to the frame member 25, wherein movement is prevented. Hence, the latching cylinders represent two different means for locking the deck 50 relative to the frame member 25.

Referring now to FIG. 6, a partial side view of FIG. 1B will now be described. The latching beam 49*a* and 49*b* is shown. The pin on the cylinders will extend through openings within the latching beams, and more specifically, through opening 49*g* and opening 49*h*. FIG. 6 also shows the hook 77*d* and 77*a*. According to the teachings of the present invention, if the pneumatic cylinders, such as cylinder 76*c*, are energized, the engagement pin will extend into and engage with the openings, thereby locking the deck 50 relative to the frame member 25.

Referring now to FIG. 7, a partial cut away view of FIG. 6 depicting the locking cylinder 76*c* and hook member 77*d*. This view shows that the cylinder 76*c* has extending therefrom the locking pin 204 that is disposed through the opening 49*g*. The cylinder 76*c* is pneumatically operated. In one preferred embodiment, there are four pneumatic cylinders as mentioned earlier. Also, the pneumatic cylinders may all be operatively attached to the main pressure source, namely nitrogen tanks 116. Alternatively, the pneumatic cylinders may have an independent pressure source. While in the most preferred embodiment, pneumatic cylinders have been shown for motion compensation, the cylinders may also be hydraulic or even manually controlled and operated.

FIG. 7 also depicts the hook member 77*d*. The hook member 77*d* may be manually operated. For activation, the hook member 77*d* is simply rotated so that the hook portion (attached to the deck 50) engages a pin 182 on the cylinder 68. This prevents extension of the inner rod from the cylinder 68.

Both latching mechanisms prevent relative movement of the deck 50 relative to the frame member 25. In the course of conducting operations, it may be advantageous to prevent movement, for instance during maintenance, remedial work, etc.

Referring to FIG. 8, a partial cross-section taken along line 8—8 of FIG. 6 will now be described. The FIG. 8 shows all four hydraulic cylinders 76*a*, 76*b*, 76*c*, 76*d* attached to the attachment plates 75*a*, 75*b*, 75*c*, 75*d*. Also, the latching beams 49*a*, 49*b*, 49*c*, 49*d* are shown.

Changes and modifications in the specifically described embodiments can be carried out without departing from the scope of the invention which is intended to be limited only by the scope of the appended claims and any equivalents thereof.

We claim:

1. A motion compensating apparatus for a floating platform on an ocean, wherein a riser extends from the ocean floor through the floating platform, the apparatus comprising:

a spacer attached to the floating platform;

a frame member operatively attached to said spacer;

a deck slidably attached to said frame member, and wherein said riser extends through said deck;

moving means, connected to said frame member and said deck, for moving said frame member relative to said deck, and wherein said moving means comprises a cylinder member operatively attached to said frame member and a piston operatively attached to said deck;

energizing means for energizing said cylinder member so that said cylinder extends from said piston thereby moving said frame member;

a track stack member that is attached to said deck; and, wherein said riser is operatively attached to said track stack member so that said deck is also attached to said riser.

2. The apparatus of claim 1 wherein a coiled tubing extends into the well.

3. The apparatus of claim 2 wherein said energizing means comprises:

a pressurized recharging vessel configured to direct a pneumatic supply to said cylinder member; and, a valve panel for regulating a pressure amount to be delivered to said cylinder member.

4. The apparatus of claim 3 wherein said energizing means further comprising a gas delivery mechanism for keeping the cylinder member within a predetermined pressure range and wherein a pressure circuit connects said gas delivery mechanism to said cylinder member.

5. The apparatus of claim 3 wherein said moving means further comprises:

a second cylinder member; and, a second piston operatively associated with said second cylindrical member.

6. The apparatus of claim 3 further comprising:

a coiled tubing injector head operatively attached to said track stack member.

7. A system for providing motion compensation on a platform attached to an ocean floor, said platform being operatively associated with a riser extending from a subterranean well, the system comprising:

a spacer attached to the platform;

a frame member operatively attached to said spacer;

a deck slidably attached to said frame member, and wherein said deck is attached to said riser;

a cylinder member operatively attached to said frame member;

a piston operatively associated with said cylinder member and wherein said piston is attached to said deck so that said frame member can be moved relative to said deck;

wherein said frame member contains a plurality of guide post and wherein said deck is slidably mounted on said guide post so that said frame member is movable relative to said deck;

energizing means for energizing said cylinder so that said cylinder extends from said piston thereby moving said frame member.

8. The system of claim 7 wherein said energizing means comprises:

a pressurized vessel configured to direct a pneumatic supply to said cylinder member; and, a valve panel for regulating a pressure amount to be delivered to said cylinder member.

9. The system of claim 8 wherein said energizing means further comprises a gas delivery mechanism for keeping the cylinder member within a predetermined pressure range and wherein a pressure circuit connects said gas delivery mechanism to said cylinder member.

10. The system of claim 8 further comprising:

a second cylinder member operatively attached to said frame member; and, a second piston operatively associated with said second cylinder member and wherein said second piston is attached to said deck so that said frame member can be moved relative to said deck.

11. The system of claim 8 further comprising:

a track stack member that is attached to said deck; and, an injection head operatively attached to said track stack member.

12. The system of claim 11 further comprising means for locking said deck to said frame member in order to prevent movement of said deck.

13. The system of claim 12 wherein said locking means comprises:

a hydraulic cylinder having an engaging pin and wherein said engaging pin engages a latching beam attached to said frame member.

14. A method of compensating for movement on an offshore platform during well operations, and wherein a riser extends from a well to the platform, the method comprising:

providing a motion compensator on said platform, said motion compensator comprising: a spacer attached to said platform; a frame member attached to the spacer, a deck slidably mounted on said frame member; a cylinder connected to said frame member and having a piston disposed therein and wherein said piston is attached to said deck;

attaching said deck to the riser;

moving the platform in a first vertical direction;

controlling the pressure into the cylinder with an energizing pressure means to said cylinder;

absorbing a force associated with the movement of the offshore platform;

energizing said cylinder by said energizing pressure means so that said cylinder extends from said piston thereby sliding said frame member relative to said deck;

moving said spacer relative to the riser so that said spacer moves while said deck remains stationary relative to the riser.

15. The method of claim 14 wherein an injector head is attached to the deck and wherein the injector head receives a coiled tubing, and the method further comprises:

lowering the coiled tubing into the riser;

performing the well operations on the well with the coiled tubing.

16. The method of claim 14 wherein the pressure within the cylinder is set at a predetermined balanced pressure state and the step of controlling the pressure into the cylinder with said energizing pressure means includes:

moving the cylinder in a downward direction in response to sea movement;

increasing the area within the cylinder;

decreasing the pressure within the cylinder;

directing a gas into the cylinder so that the pressure within the cylinder increases;

increasing the pressure within the cylinder to the predetermined balanced pressure state.

17. The method of claim 14 wherein the pressure within the cylinder is set a predetermined balanced pressure state and the step of controlling the pressure into the cylinder with said energizing pressure means includes:

moving the cylinder in an upward direction in response to sea movement;

decreasing the area within the cylinder increasing the pressure within the cylinder;

directing a gas from the cylinder so that the pressure within the cylinder decreases;

decreasing the pressure within the cylinder to the predetermined balanced pressure state.

18. The method of claim 14 further comprising:

extending an engagement pin from a cylinder, wherein said cylinder is attached to said deck;

engaging said engagement pin with a latching beam, wherein said latching beam is attached to said frame member;

preventing the sliding of said frame member relative to said deck.

* * * * *